United States Patent [19]

Anthony

[11] Patent Number: 4,526,006

[45] Date of Patent: Jul. 2, 1985

[54] HEAT TRANSFER METHOD AND APPARATUS

[76] Inventor: George M. Anthony, Eldorado Club, P.O. Box 346, Gardena, Calif. 90247

[21] Appl. No.: 96,922

[22] Filed: Nov. 23, 1979

[51] Int. Cl.[3] ..... F01K 25/08; F22B 1/02

[52] U.S. Cl. ..... 60/671; 122/33; 60/653; 60/654; 60/667

[58] Field of Search ..... 122/33; 60/651, 671, 60/653, 654, 670, 667

[56] References Cited

U.S. PATENT DOCUMENTS

| | | | |
|---|---|---|---|
| 677,863 | 7/1901 | Gibbs | 60/667 |
| 679,252 | 7/1901 | Clover | 60/667 |
| 3,411,300 | 11/1968 | Schuetzenduebel | 60/647 |
| 3,477,412 | 11/1969 | Kitrilakis | 122/33 |
| 3,522,909 | 8/1970 | Arant | 122/33 |
| 3,712,073 | 1/1973 | Arenson | 122/33 |
| 3,793,993 | 2/1974 | Teagran | 122/33 |

*Primary Examiner*—Allen M. Ostrager
*Attorney, Agent, or Firm*—Bruce A. Jagger

[57] ABSTRACT

A boiler for a heat sensitive working fluid in which there are three systems, first, a stream of hot combustion gas system, second, a heat transfer fluid system and lastly, a heat sensitive working fluid system. The heat transfer fluid is at the interface between the hot combustion gas and the working fluid so as to prevent the formation of hot spots.

13 Claims, 5 Drawing Figures

HEAT TRANSFER METHOD AND APPARATUS

Figure 1:
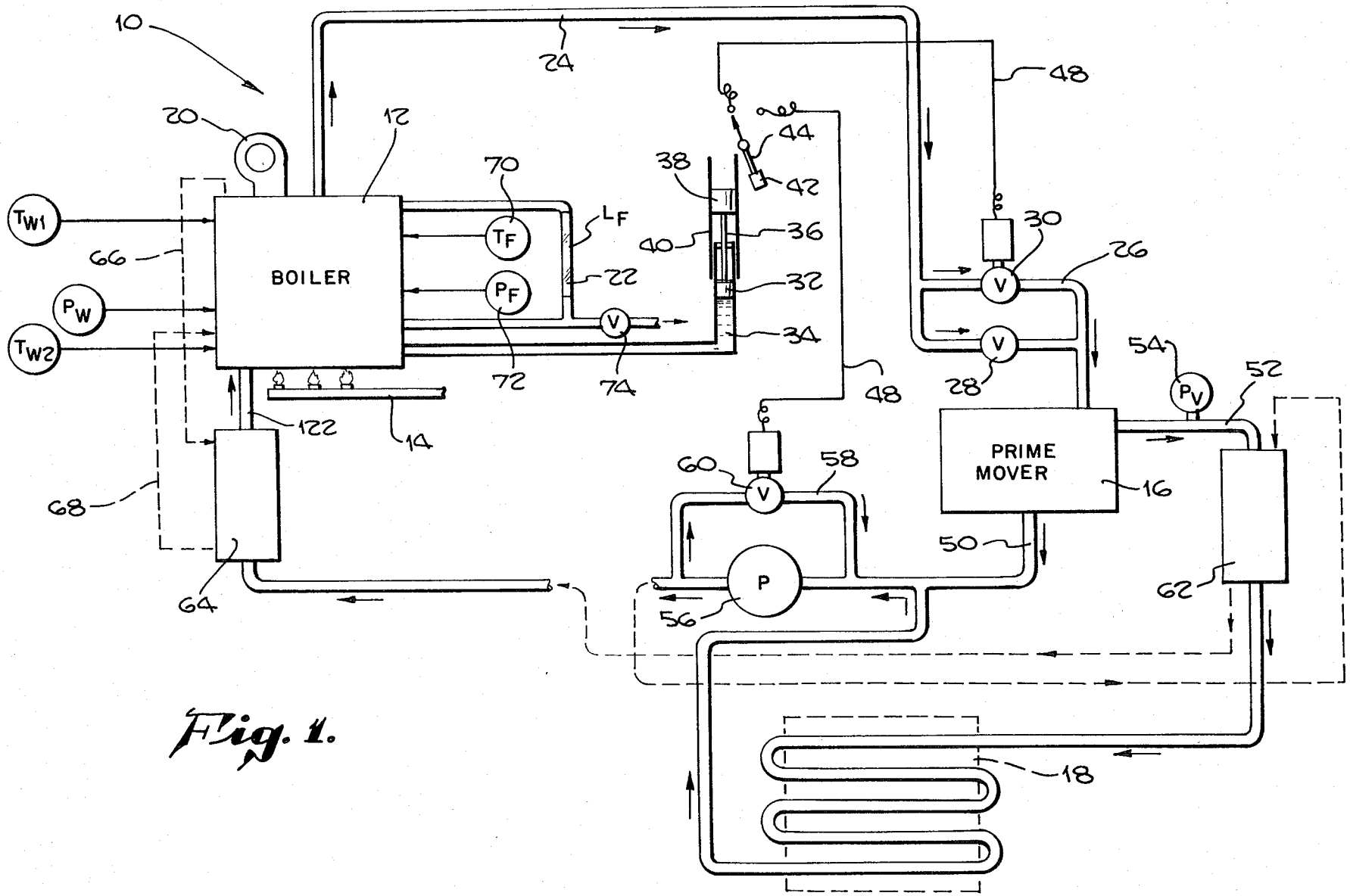

This invention relates to heat transfer and the generation of power, and more particularly this invention relates to heat transfer and the generation of power utilizing a heat sensitive working fluid.

Previously, considerable difficulty had been encountered in transferring heat to heat sensitive working fluids such as fluorocarbons, particularly where the fluorocarbons were used in closed systems under conditions where decomposition products tended to accumulate. Previously, problems had been encountered in regulating power generating systems without the use of complicated governor mechanisms.

These and other difficulties of the prior art have been overcome according to the present invention wherein a boiler and prime mover system are provided in which a heat sensitive fluid is used as the working medium in a closed system. An interface is provided between the heat sensitive working fluid and the heat source. A heat distributing fluid is provided at the interface between the working fluid and the heat source so that the occurrence of hot spots is prevented. Heat transferred between the heat source and the working fluid takes place through this interface. This protects the heat sensitive working fluid from decomposition and also protects the structure from the excessive forces and adverse reaction which occur as a result of hot spots. Also the presence of a heat distributing fluid at the interface permits the use of thinner walls in the structure between the working fluid and the heat source. The use of thinner walls in the heat transfer area permits more efficient heat transfer.

In general, the present invention contemplates the inter-reaction and cooperation of three systems to achieve the unexpected results enjoyed by users of the present invention. These three systems are first, a heat source which is conveniently a hot combustion gas, second, a closed working fluid system which includes a heater, a prime mover and a condenser, and lastly, a heat distributing fluid system at the interface between the heat source and the working fluid. A hot combustion gas is generated and this hot gas is past at least once and preferably several times through a heat transfer area. The passage of the hot gas may be augmented by the use of exhaust or input blowers.

A heat sensitive working fluid is provided so as to receive heat from the hot combustion gases. The working fluid receives the heat primarily in the liquid phase and is thereby converted to the vapor phase. The vapor phase is then super-heated and conducted to a prime mover where a portion of the energy therein is extracted and converted to mechanical energy. The spent working fluid is then condensed and pumped or injected into the interface section against the pressure which is applied to the working fluid in that section.

At the interface between the hot combustion gases and the working fluid a thin but effective layer of heat distributing fluid is provided. This thin layer of heat distributing fluid circulates by reason of conduction currents as well as by induced circulation to distribute the heat uniformly across the interface. The heat distributing fluid is normally liquid at all location in the interface section, however, the heat which is transferred through it does cause it to vaporize and this vapor phase heat distributing fluid is utilized in a super-heat section to super-heat the vaporized working fluid. The super-heat section is separate from the interface section and both the fluids are in the vapor phase. If the hot combustion gases heat the super-heat section directly the structure must be designed to accomodate this without the presence of a layer of liquid heat distributing fluid. The vapor phase heat distributing fluid is conducted from the super-heat section to a working fluid preheater section. In the working fluid preheater section part of the heat in the vapor phase heat distributing fluid is transfered to liquid phase working fluid just prior to the working fluids being injected into contact with the interface. In general, the aggregate of the heat which is transfered out of the vapor phase working fluid in the super-heat and working fluid preheater sections results in the cooling and condensation of a substantial portion of the vaporized heat distributing fluid. The resultant condensed heat distributing fluid is then returned to the interface. The decrease in temperature and resultant decrease in pressure which occurs as the vaporized heat distributing fluid passes through the super-heat and preheat sections aids in inducing a circulation in the heat distributing fluid. This fluid circulates in the direction from the top of the liquid body of heat distributing fluid through the super-heat and preheater sections and back to the approximate bottom of the body of liquid heat distributing fluid. This induced circulation aids in the uniform distribution of heat as well as preventing the occurence of stagnant bubbles or pockets in the liquid at the interface which might contribute to the formation of hot spots.

The level of liquid working fluid in the region of the interface can be utilized to control both the rate at which vapor phase working fluid is supplied to a prime mover and the rate at which condensed liquid working fluid is injected back into the area of the interface.

The control of the flow of vapor phase working fluid to the prime mover or other energy utilizing device is conveniently accomplished by the combination of a metering valve which can be manually set and a control valve which is located in a bypass around the metering valve. The control valve is actualable responsive to changes in the level of the liquid working fluid in the interface section. The metering valve is normally set in a partially open configuration so that vapor flows to the prime mover at a minimum rate sufficient to maintain the prime mover in operation under light or no load conditions. As the liquid level of the working fluid at the interface falls the control valve is actuated so that it opens and bypasses the metering valve, thus delivering more working fluid to the prime mover. In general, this control of the rate of delivery of working fluid to the prime mover serves to maintain the prime mover operating at substantially a constant revolution per minute under varying load conditions.

The spent working fluid from the prime mover is condensed and is injected back into the region of the interface against the pressure which is present on the working fluid in that region. The rate at which the condensed working fluid is injected back to the interface section is controlled responsive to the liquid level of the working fluid in the region of the interface. A pump is provided, which is preferably a positive displacement pump such as a gear pump, in the condensed working fluid return line. This pump is conveniently operated at continuous rate. The rate of injection is controlled by providing a fluid path which extends in a loop from the output to the input of the pump. A valve which is controllable responsive to variations in the liquid level of the liquid working fluid in the region of the interface is provided in the return loop. When the liquid level of the working fluid at the interface is high the valve in the pump recycle loop is opened so that the pump is merely recycling fluid from its outlet back to its inlet. As the liquid level falls the valve closes and the pump causes working fluid to be injected into the interface section. In the interests of conserving heat the condensed working fluid downstream from the pump is conveniently passed in heat exchange relationship through a preheater which is positioned between the prime mover and the condenser on the line which is carrying vapor phase working fluid which has been exhausted from the prime mover. In this way some heat is recovered from the exhausted vapor phase working fluid and the efficiency of the system is improved.

Various safety devices are provided in accordance with conventional procedures on all three of these systems, namely the heat distributing fluid system, the combustion gas system and the working fluid system, as may be desired or required. Both the working fluid and heat distributing fluid systems are closed systems to which fluid may be added from time to time. Various temperature and pressure sensing and recording devices are provided, as desired. The temperature and pressure of the heat distributing fluid and the working fluid are obtained through the use of conventional pressure and temperature sensing instruments. Preferrably, the temperature of the heat distributing fluid should be measured at approximately the top and approximately the bottom of the liquid portion of such heat distributing fluid in the interface section. While the working fluid is being injected into the interface section the temperature at the top will be greater than that at the bottom.

The present invention is particularly suited for use with working fluids which are heat sensitive. Heat sensitive working fluids tend to decompose when subjected to very high temperatures. Such working fluids enjoy some substantial advantages but are unuseable with many systems because of their tendency to decompose. Such heat sensitive working fluids include, for example, certain of the "Freon" fluorocarbons. "Freon" is a trademark of E. I. du Pont de Nemours and Company, Wilmington, Del. The "Freon" compounds which are particularly suited for use according to the present invention have low boiling points and low heats of vaporization. The characteristics of these "Freon" compounds when used as the working fluid in the present system permit the use of relatively low temperatures and pressures. The system is thus simpler and safer to operate, and the materials of construction are relatively inexpensive, lightweight and easy to fabricate. "Freon" compounds are very stable, however, at elevated temperatures and particularly in the presence of water and certain metals the "Freon" compounds decompose slightly. The decomposition products of the "Freon" compounds generally include hydrogen fluoride and usually hydrogen chloride. When mixed with water these become, respectively, hydrofluoric acid and hydrochloric acid. These are strong acids which will readily attack the materials of construction which are used in the system. For this reason, where "Freon" compounds are used as the working fluid it is necessary to avoid conditions which might result in the decomposition of the "Freon" compounds. Providing an effective layer of heat distributing fluid at the interface between the "Freon" compounds and the heat source prevents the decomposition of these compounds.

Lubricating oils are generally quite soluble in "Freon" compounds. Lubricating oils are generally used with the moving components of the system, including the prime mover. "Freon" compounds tend to dissolve lubricating oils and carry them throughout the system so that after a brief operating period there will be a significant amount of lubricating oil dissolved in the "Freon" compounds in the interface section. It has been discovered that with certain "Freon" compounds, and in particular with "Freon" 11 which has the molecular formula $CCl_3F$ the lubricating oil and "Freon" compounds separate into two liquid phases in the interface section as the temperature and pressure of the "Freon" compound are increased to working levels. The lubricating oil layer may be withdrawn from the interface section through a suitable drain. The solubility of lubricating oils in "Freon" compounds can be utilized to advantage in effecting thorough lubrication of the prime mover. Dissolving the lubricating oil in the "Freon" compound prior to its reaching the primer mover insures that the moving parts contacted by the working fluid will be adequately lubricated.

Figures 2, 3:
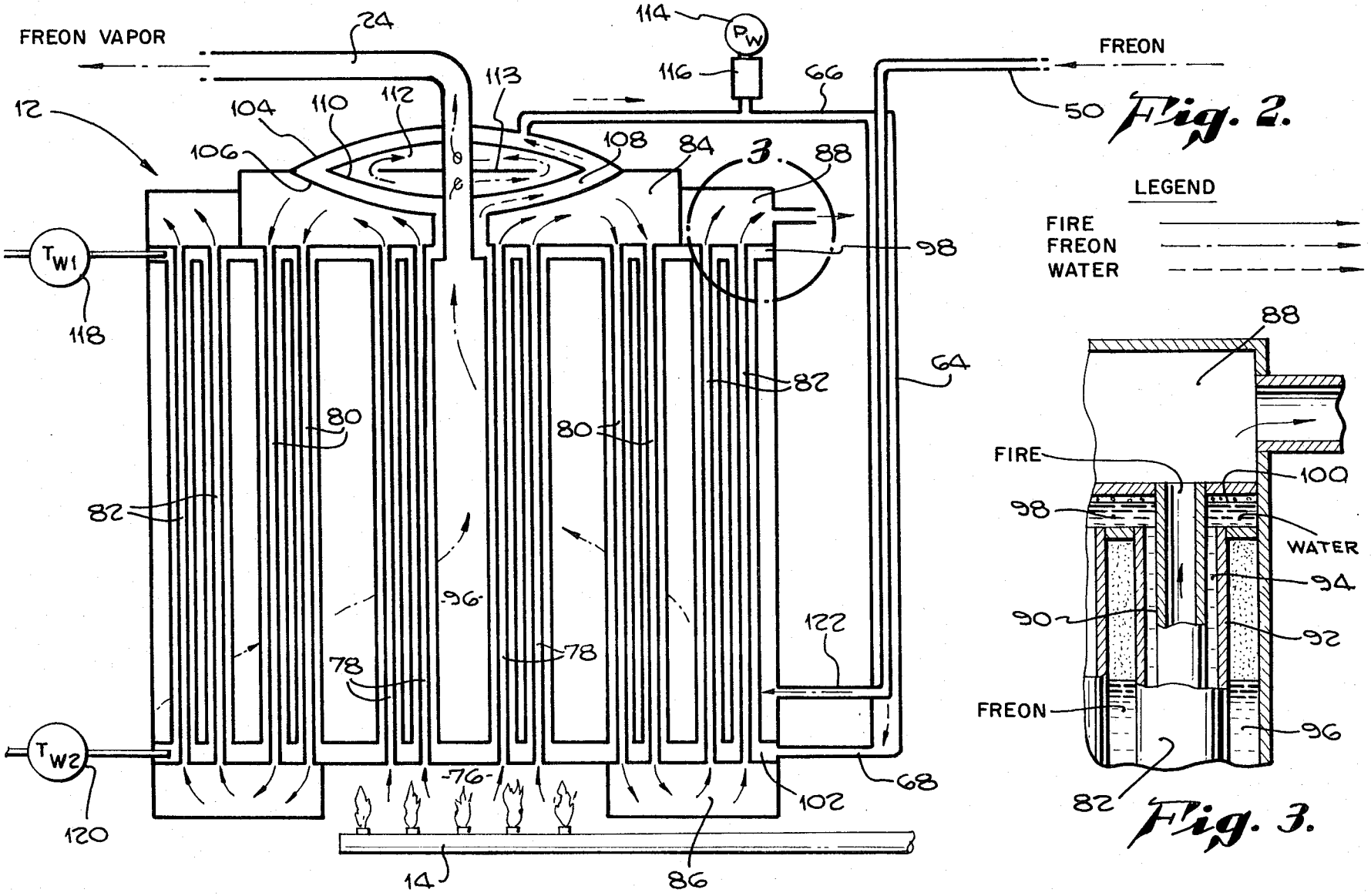
Figures 4, 5:
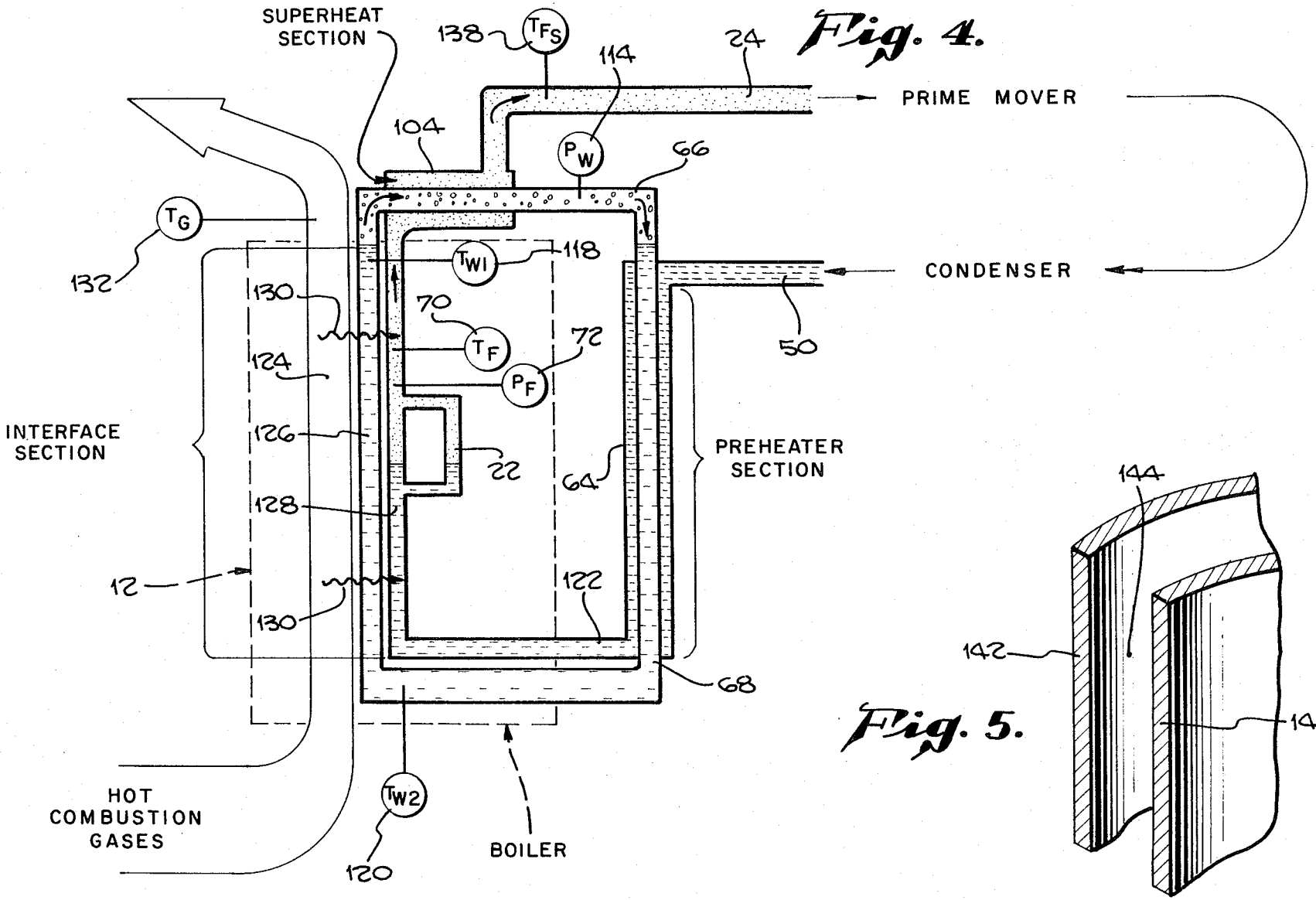

Referring particularly to the drawings for the purposes of illustration only and not limitation there is schematically shown:

FIG. 1, a schematic representation of a power generating system according to the present inventions;

FIG. 2, a diagrammatic representation of the boiler portion of the system illustrated in FIG. 1;

FIG. 3, a fragmentary enlarged cross-section of a portion of the boiler illustrated in FIG. 2;

FIG. 4, a schematic representation of the three fluid systems utilized in the embodiment of FIG. 1; and FIG. 5, a fragmentary perspective cross-sectional view of an interface structure for use according to the present invention.

Referring particularly to the drawings, there is illustrated generally at 10 a power generating system which includes a boiler 12, a heat source 14, prime mover 16 and a condenser 18. The working fluid operates within in a closed system where it is vaporized in boiler 12 by heat generated at heat source 14. The resultant vaporized working fluid is conducted to the prime mover where the energy in the working fluid is converted to mechanical energy. The spent working fluid is then condensed in condenser 18 and is injected back into the working fluid side of boiler 12.

The heat source 14 is conveniently a burner which generates hot combustion gases. The combustion gases preferably are conducted along a torturous path in boiler 12 so that they pass through the boiler several times before being exhausted. The passage of the hot combustion gases through boiler 12 is augmented by exhaust fan 20.

A sight glass 22 permits visual monitoring of the liquid level of the working fluid within boiler 22. Vaporized working fluid is conducted via conduit 24 to prime mover 16. Conduit 24 is provided with a control loop 26 upstream from prime mover 16. Conduit 24 contains a metering valve 28 which is capable of being manually adjusted to permit the desired flow rate of working fluids to prime mover 16. In operation metering valve 28 is generally set to establish a desired flow rate. In response to increase demand control valve 30 automatically opens, thus bypassing metering valve 28 and supplying working fluid at a greater rate to prime mover 16. Control valve 30 opens responsive to a change in the liquid level of working fluid in boiler 12.

A float 32 is provided in leg 34. Float 32 floats on the surface of the liquid working fluid. Leg 34 connects with the working fluid side of boiler 12 so that the position of float 32 in leg 34 accurately reflects the position of the liquid level of the working fluid in boiler 12. Rod 36 projects upwardly from and is carried by float 32. A ferrous mass 38 is mounted on the upper end of rod 36 and moves in guide 40 responsive to changes in the position of float 32. A magnet 42 is mounted on switch arm 44. Switch arm 44 is normally biased so that electrical current is flowing in line control valve 30 open. In this configuration working fluid is flowing through control loop 26 to prime mover 16.

Some portion of the spent working fluid which is exhausted from prime mover 16 is in the liquid state and is exhausted through liquid conduit 50. The vapor phase portion of the spent working fluid is exhausted through exhaust vapor conduit 52. The pressure of the spent vapor phase working fluid is indicated by pressure gauge 54. The spent vapor phase working fluid is condensed in condenser 18 and the resultant liquid phase working fluid is conveyed to liquid conduit 50 on the upstream side of pump 56. Pump 56 is preferably a positive displacment pump which serves to inject liquid working fluid into the boiler 12 against the pressure which exists on the working fluid side of boiler 12.

A recycle loop 58 is provided from the output to the input side of pump 56. Recycle control valve 60 is positioned in recycle loop 58. When the liquid level on the working fluid side of boiler 12 rises so that magnet 42 is attracted to Ferrous mass 38 an electric current is passed through line 48 so as to open recycle control valve 60. Under conditions of high liquid levels in boiler 12 the working fluid is cycled through recycle loop 58. The pressure in the boiler on the working fluid side is such that it will prevent the injection of working fluid into the boiler when recycle control valve 60 is open. A check valve, not illustrated, is preferably provided upstream in liquid conduit 50 from recycle loop 58 so as to prevent liquid-working fluid from being expelled from the boiler back into the condenser 18 and prime mover 16.

The condensed working fluid downstream from pump 56 in liquid conduit 50 is preferrably passed through two preheater stages. First, preheater 62 extracts heat from the spent vapor phase working fluid as it is exhausted from prime mover 16. Second preheater 64 extracts heat from a heat distributing fluid and serves to induce circulation in that fluid on the interface side of boiler 12. Heat distributing fluid is removed from boiler 12 through conduit 66 and is returned to the interface side of boiler 12 through conduit 68 after passing through second preheater 64. The temperature of the working fluid in boiler 12 is measured by temperature probe 70. The pressure of the working fluid in boiler 12 is measured by pressure gauge 72. A valve 74 is provided to permit withdrawal of liquids from approximately the bottom of the working fluid side of boiler 12.

Referring particularly to FIGS. 2 and 3, there is illustrated schematically a boiler according to the present invention. The boiler illustrated is of the fire tube plural pass type wherein hot combustion gases generated in fire box 76 pass upwardly through a plurality of fire tubes on a first pass through the boiler. The hot combustion gases are discharged from fire tubes 78 into gas manifold 84. The combustion gases then enter fire tubes 80 and pass downwardly through the boiler 12 for a second pass. The hot combustion gases are discharged into gas manifold 86 and from there they pass for the third and final time through the boiler in fire tubes 82. From the discharge side of fire tubes 82 the combustion gases enter discharge manifold 88 and are exhausted from the system. The fire tubes are of a double walled construction, as illustrated particularly in FIG. 3, wherein a layer of heat distributing fluid, illustrated to be water, is positioned at the heat transfer interface between the working fluid, illustrated to be a Freon compound, and the hot combustion gases. The structure at the interface includes an inner conduit 90 which is spaced from an outer jacket 92. The annular space 94 between inner conduit 90 and outer jacket 92 is of sufficient width to contain an effective amount of a heat distributing liquid. The working fluid is contained on the shell side 96 of boiler 12. The presence of a heat distributing liquid at the heat transfer interface prevents the formation of hot spots in both outer jacket 92 and inner conduit 90. This serves to protect both the structure and the working fluid from deterioration due to the effects of excessive localized heat. Heat transfer occurs primarily in the body of boiler 12 through the fire tubes 78, 80 and 82, respectively.

The layer of heat distributing liquid is as thin as possible so as to minimize heat loses in transferring heat through this layer. The layer is, however, of sufficient thickness, and preferrably just sufficient thickness, to prevent the formation of hot spots in either inner conduit 90 or outer jacket 92. The occurence of hot spots is determined by observing the generation of decomposition products in a heat sensitive working fluid or by physical examination of the fire tube structure for signs of overheating in localized areas. In general, the layer of heat distributing liquid should be at least approximately forty thousanths of an inch in thickness and preferrably approximately sixty thousanths. In general, thicknesses in excess of approximately one tenth of an inch serve no useful purpose in the uniform distribution of heat and may tend to significantly impede heat transfer through the interface. Layers or bodies of water are maintained at the opposite ends of the vertically extending fire tubes. In general, the layers of water or other heat distributing liquid at the remote ends of the fire tubes at least are from about one quarter to one half inch thick and may be thicker if desired. The mass of heat distributing fluid should be kept to about the minimum required for efficient and effective operation so as to minimize heat losses. Keeping the upper ends of the fire tubes well covered with heat distributing liquid prevents the fire tubes from being inadvertently uncovered during the operation of the boiler 12. The body of heat distributing liquid which is present on the layer at the bottom of the fire tube serves as a reservoir for the heat distributing liquid which is present at the heat transfer interface. Normally the heat distributing fluid is liquid at all locations throughout the heat transfer interface, however, momentary interuptions such as are occasioned by the formation of bubbles, momentary fluctuations in the level of the heat transfer liquid, and the like, may briefly uncover portions of the interface. The depth of the heat distributing fluid in header space 98 at the top of the fire tubes should be sufficient so that minor fluctuations in the level of the heat distributing fluid will not expose the interface. The liquid level 100 in header space 98 should be maintained so that there is at least three sixteenth of an inch and preferrably more liquid over the upper end of annular space 94.

In order to maximize the heat transfer area at the interface a large number of fire tubes of relatively small diameter are generally employed. Fire tubes having inside diameters of from approximately one half to one inch are generally satisfactory. A large number of fire tubes are employed in each pass through the boiler so that there may be as many as several hundred fire tubes in the boiler.

The vaporized working fluid passes from the shell side 96 of boiler 12 to a super-heat section 104. The function of the super-heat section is to heat the working fluid vapor sufficiently so that it will not be condensed until it is spent in the prime mover. The super-heat section 104 utilizes primarily the heat in the vaporized heat distributing fluid to super-heat the vaporized working fluid. The hot combustion gases also add some heat to the vaporized heat distributing fluid in the super-heat section. The materials of construction in the super-heat section are generally heavier so as to accommodate direct contact with the hot combustion gases without damaging the structure. The combustion gases impinge on plate 106 which is generally saucer shaped. A passage 108 is defined between plate 106 and plate 110. Vaporized heat distributing fluid flows in this passage. Heat is transmitted from the heat distributing fluid in passage 108 to the vaporized working fluid in cavity 112. The working fluid is forced to circulate around through cavity 112 in contact with plate 110 by reason of the existence and positioning of baffel 113. From the super heat section 104 the resultant super heated working fluid passes through conduit 24 to prime mover 16. Vaporized heat distributing fluid passes out of the super heat section 104 through line 66 to second preheater 64 and via conduit 68 back to the interface side of boiler 12. The pressure on the heat distributing fluid system is measured by pressure gauge 114. A pressure absorber 116 is provided in the heat distributing fluid system so as to accommodate momentary pressure surges on the interface side of boiler 12. The temperature of the heat distributing fluid on the interface side of the boiler 12 is measured in both of header spaces 98 and 102. During periods of operation when working fluid is being injected onto the shell side 96 of boiler 12 the temperature in header space 98 as indicated at 118 will be higher than that indicated at 120 in header space 102. When working fluid is not being injected onto the shell side of boiler 12 through conduit 122 the temperatures indicated at 118 and 120 will be about the same.

Referring particularly to FIG. 4 there is illustrated schematically the three systems which function in boiler 12. On the tube side of boiler 12 a stream of hot combustion gases passes through the boiler as indicated at 124. On the interface side of the boiler 12 a layer of heat distributing liquid, preferrably water, is indicated at 126. On the shell side of boiler 12 a body of working fluid, preferrably a Freon compound is indicated at 128. Heat flows in the interface section, as indicated at 130, from the stream of hot combustion gases 124, through the layer of liquid heat distributing liquid 126 and into the working fluid 128. Inevitably the layer of liquid heat distributing fluid 126 is heated and vaporized. The heat in the heat distributing fluid is utilized to super-heat the working fluid at 104. Additional heat in the vaporized heat distributing fluid is used to preheat working fluid at 64 just prior to its being injected back into the interface section of boiler 12. The resultant cooling of the heat distributing fluid in second preheater 64 serves to induce circulation in the heat distributing fluid system in a clockwise direction as viewed in FIG. 4.

For a typical operation of the boiler 12 where the working fluid is Freon 11 compound and the heat distributing fluid is water. Freon 11 has the molecular formula $CCl_3F$. The pressure as indicated at 114 on the interface side of the boiler is fifty pounds per square inch gauge. The temperature of the water, while condensed working fluid is being injected through conduit 122, is indicated at 118 to be two hundred and fifty degrees Fahrenheit and two hundred and twenty degrees Fahrenheit at 120. The temperature of the hot combustion gas as it is exhausted from the system is two hundred and seventy five degrees as indicated at 132. The temperature of the working fluid indicated at 70 is about 230 degrees Fahrenheit and its pressure, as indicated at 72, is about 175 pounds per square inch gauge. The temperature of the super-heated working-fluid, as indicated at 138, is approximately 250 degrees Fahrenheit. Freon 12 compound as well as other Freon compounds and other working fluids may be utilized if desired according to the present invention. Preferred fluorocarbons contain from one to two carbon atoms.

The heat distributing fluid is preferrably selected so that the interface side of boiler 12 is operated at a temperature which at its maximum is at least approximately 25 and preferably 50 degrees Fahrenheit below the boiling point of the heat distributing liquid throughout the range of operating pressures involved. Maintaining the maximum temperature on the interface side of boiler 12 well below the boiling point of the heat distributing fluid aids in maintaining the heat distributing fluid in the liquid phase at the interface and also avoids the loss of heat which would occur by of the phase change in vaporing the heat distributing fluid at its boiling point.

In general, the operation of boiler 12 is controlled so that the liquid level of the working fluid in the interface section does not rise beyond approximately two thirds of the height of the interface section and does not fall below approximately one third the height of the interface section. As has been described previously, hereinabove, the liquid level of the working fluid in the interface section is conveniently used to control the rate at which super-heated working fluid is delievered to the primer mover, as well as the rate at which condensed working fluid is injected back into the shell side of boiler 12 in the interface section.

Where lubricating oil is utilized with, for example Freon 11 compound, the lubricating oil begins to separate out into a separate liquid phase which settles below the Freon 11 layer in boiler 12 at temperatures as low as about one hundred and seventy five degrees Fahreheit. This separate liquid phase is withdrawn from the shell side of boiler 12 through valve 74.

Referring particularly to FIG. 5, there is illustrated a perspective fragmentary cross-sectional view of a jacketed tube or conduit which is adapted for use according to the present invention. The inner structure is conduit wall 140 and the outer structure is jacket wall 142. There is a space 144 provided between walls 140 and 142. The space 144 is the interface area between the walls 140 and 142 through which heat is transferred from a heat source to a working fluid. The structure of FIG. 5 is useful in either a fire tube type boiler or heat exchanger or a water tube type boiler or heat exchanger. In a fire tube type boiler the heat source is inside the conduit so that hot combustion gases, for example, would be flowing along wall 140 and working fluid would be against the surface of jacket wall 142. In a water tube type boiler the working fluid is against tube wall 140 and the hot gases or other heat source are applied on the shell side of the boiler against wall 142.

As discussed previously hereinabove, the width of space 144 should be sufficient to provide an effective amount of heat transfer liquid to prevent the formation of hot spots. In general, for lower temperature boilers the minimum width of space 144 should be at least approximately forty thousandths of an inch. Excessively wide interface spaces cause unnecessary heat loses and should be avoided. The width of interface which is just sufficient to accomplish the desired uniformity of heat distribution is readily determined for a particular boiler structure and system. The occurence of hot spots can be determined experimently by careful analysis of the working fluid and also by inspecting the structure after it has been in use for some period of time. In general, structural deterioration due to hot spots is more likely to occur on the fire side of the interface, although, if corrosive decomposition products are allowed to build up on the working fluid side of the interface the structure on that side may be heavily corroded within a very short period of time. As a safety precaution a material which is readily attacked by the decomposition products of the working fluid may be positioned in line 24 or elsewhere in the working fluid system out of boiler 12 where it is readily accessible for periodic examination. If this material begins to show evidence of being corrosively attacked, this is an indication that the working fluid may be breaking down at a hot spot and appropriate measures should be taken to locate and eliminate the hot spot. As a further safety precaution a check valve may be placed in conduit 122 so that a rupture in the lines which carry the working fluid outside of the boiler will not result in emptying the pressurized working fluid out of the boiler with potentially explosive scaling force.

What has been described are preferred embodiments in which modifications and changes may be made without departing from the spirit and scope of the accompanying claims.

What is claimed is:

1. Apparatus for generating power comprising:

means for establishing a heat transfer interface having a first side and a second side;

means for generating heat and applying said heat to said first side;

means for providing a closed working fluid system including means for contacting a working fluid with said second side to receive said heat, means for delivering the resultant heated working fluid to a means for extracting energy from said working fluid, and means for returning said working fluid to said second side; and means for providing an effective layer of heat distributing fluid normally throughout said interface between said first and second sides, whereby the occurrence of hot spots at said interface is prevented, said heat distributing fluid being present in both a liquid phase and a vapor phase, said heat distributing fluid normally being in the liquid phase at said interface, means for conducting said vapor phase heat distributing fluid toward a heat transfer station, means for withdrawing heat from said heat distributing fluid at said heat transfer station, means for passing said returning working fluid through said heat transfer station to receive the heat withdrawn from said heat distributing fluid at said heat transfer station, means for recycling said heat distributing fluid to said interface.

2. Apparatus of claim 1 including means for inducing circulation in said heat distributing fluid.

3. Apparatus of claim 1 including means for passing said vapor phase heat distributing fluid at a location removed from said interface to super-heat said heated working fluid before said heated working fluid reaches said means for extracting energy.

4. Apparatus of claim 1 wherein said working fluid has a vapor phase and a liquid phase in contact with said second side and said resultant heated working fluid is in the vapor phase, means for controlling the rate at which said heated working fluid is delivered to said means for extracting energy responsive to changes in the level of the liquid phase working fluid in contact with said second side.

5. Apparatus of claim 1 wherein said working fluid has a vapor phase and a liquid phase in contact with said second side, means for controlling the rate of returning said working fluid to said second side responsive to changes in the level of said liquid phase working fluid in contact with said second side.

6. Method of generating power comprising:

establishing a heat transfer interface having a first side and a second side;

generating heat and applying said heat to said first side;

providing a closed working fluid system including contacting a working fluid with said second side to receive said heat, delivering the resultant heated working fluid to a means for extracting energy from said working fluid, and returning said working fluid to said second side; and providing an effective layer of heat distributing fluid normally throughout said interface between said first and second sides whereby the occurrence of hot spots at said interface is prevented, said heat distributing fluid being present in both a liquid phase and a vapor phase, said heat distributing fluid normally being in the liquid phase at said interface, conducting said vapor phase heat distributing fluid toward a heat transfer station, withdrawing heat from said heat distributing fluid at said heat transfer station, passing said returning working fluid through said heat transfer station to receive the heat withdrawn from said heat distributing fluid at said heat transfer station, and recycling said heat distributing fluid to said interface.

7. Method of claim 6 including controlling the rate at which said heated working fluid is delivered to said means for extracting energy.

8. Method of claim 6 including controlling the rate of returning said working fluid to said second side.

9. Method of claim 6 wherein said working fluid is a heat sensitive fluid.

10. Method of claim 6 wherein said working fluid is a fluorocarbon having from 1 to 2 carbon atoms.

11. Method of claim 6 including generating a stream of hot gas and passing said hot gas in contact with said first side.

12. Method of generating power comprising the steps of:

establishing a heat transfer interface having a first side and a second side;

generating heat and applying said heat to said first side;

providing a closed working fluid system including contacting a liquid phase working fluid with said second side to receive said heat and vaporize said working fluid, super-heating and delivering the resultant heated vaporized working fluid at a controlled rate to a means for extracting energy from said working fluid, condensing and returning the resultant condensed working fluid at a controlled rate to said second side;

providing an effective layer of heat distributing liquid normally throughout said interface between said first and second side;

vaporizing a portion of said heat distributing liquid and utilizing said vaporized portion to super-heat said working fluid in said super-heating step;

passing said vaporized portion toward a preheater means for said returning working fluid;

permitting heat to transfer from said heat distributing fluid to said returning working fluid in said preheater means; and recycling said heat distributing fluid to said heat transfer interface.

13. Apparatus for generating power including a closed working fluid system comprising:

boiler means for vaporizing a heat sensitive working fluid;

super-heat means for super-heating said working fluid after it is discharged from said boiler means;

means for extracting energy from said working fluid after it is discharged from said super-heat means;

preheat means for preheating said working fluid after it is discharged from said means for extracting energy and before it is returned to said boiler means;

means for establishing a heat transfer interface within said boiler means, said heat transfer interface having a first side and a second side;

means for providing an effective layer of heat distributing fluid normally throughout said interface between said first and second sides, whereby the occurrence of hot spots at said interface is prevented.

* * * * *